US008869448B1

(12) United States Patent
Lee

(10) Patent No.: US 8,869,448 B1
(45) Date of Patent: Oct. 28, 2014

(54) APPARATUS FOR AUTOMATICALLY CONTROLLING CROSSING GATE BY SENSING LIGHT

(71) Applicant: Sung Chang Telecom Co., Ltd., Cheongju-si (KR)

(72) Inventor: Jai-Jin Lee, Cheongju-si (KR)

(73) Assignee: Sung Chang Telecom Co., Ltd. (KR)

( * ) Notice: Subject to any disclaimer, the term of this patent is extended or adjusted under 35 U.S.C. 154(b) by 0 days.

(21) Appl. No.: 14/078,669

(22) Filed: Nov. 13, 2013

(51) Int. Cl.
*E05F 15/20* (2006.01)

(52) U.S. Cl.
USPC ..... 49/13; 340/507

(58) Field of Classification Search
USPC ..... 49/13, 14, 25, 35; 340/5.7, 5.71
See application file for complete search history.

(56) References Cited

U.S. PATENT DOCUMENTS 3,781,853 A * 12/1973 Jacobs ..... 340/985
4,754,416 A * 6/1988 Adams et al. ..... 340/985
7,336,037 B2 * 2/2008 Bruwer ..... 315/200 A
2007/0195522 A1 * 8/2007 Matthews et al. ..... 362/205
2011/0111849 A1 * 5/2011 Sprague et al. ..... 463/31
2011/0151833 A1 * 6/2011 Snider et al. ..... 455/410
2013/0033359 A1 * 2/2013 Ji et al. ..... 340/5.7
2013/0151027 A1 * 6/2013 Petrucci et al. ..... 701/1

* cited by examiner

*Primary Examiner* — Katherine Mitchell
*Assistant Examiner* — Justin Rephann
(74) *Attorney, Agent, or Firm* — Cantor Colburn LLP

(57) ABSTRACT

An apparatus for automatically controlling a crossing gate being installed at an entrance/exit way of a vehicle and controlling entrance/exit of the vehicle, including: a password setting unit for setting a combined row of input numbers or characters as a password; a signal sensing unit for sensing a change in an amount of light of light signal patterns of the vehicle; and a controller including a first signal converter that analyzes the sensed change in the amount of light of light signal patterns of the vehicle and that converts the analyzed light signal patterns into a Morse code, a second signal converter that converts the converted Morse code into a combined row of numbers or characters, and a driving controller that controls opening/closing of the crossing gate depending on whether the converted combined row of numbers or characters is the same as the password set by the password setting unit.

3 Claims, 4 Drawing Sheets

APPARATUS FOR AUTOMATICALLY CONTROLLING CROSSING GATE BY SENSING LIGHT

BACKGROUND OF THE INVENTION

1. Field of the Invention

The present invention relates to a crossing gate (or is referred to as a 'crossing gate for a vehicle') that is installed at a doorway of an apartment house, a public parking lot, a parking lot in a building or a highway tollgate and that controls entrance and exit of a vehicle, and more particularly, to an apparatus for automatically controlling a crossing gate by sensing a light, in which the crossing gate is capable of being open according to a change in an amount of light of light signal patterns of a vehicle close to the crossing gate.

2. Description of the Related Art

In general, a crossing gate for controlling entrance and exit of a vehicle is installed at a doorway of an apartment house, a public parking lot, a parking lot in a building or a highway tollgate, and the crossing gate is usually open and closed in a wireless communication manner.

In a crossing gate in a wireless communication manner, a radio frequency (RF) card is installed for entrance and exit of the vehicle, and a card reader is installed at the crossing gate. The card reader is connected to a control terminal installed at a particular place, for example, a management office, via a wired/wireless communications network.

Thus, when the vehicle is close to the crossing gate, the card reader reads the RF card installed at the vehicle and transmits a result of recognition to the control terminal so that the control terminal controls the crossing gate to be open and entrance and exit of the vehicle can be performed.

However, in the above-described, existing crossing gate, an RF card should be additionally installed at the vehicle, which causes many costs for manufacturing the crossing gate.

Also, when the RF card is installed at the vehicle according to the related art, if there are a plurality of places, for example, a house, an office, and the like, in which the vehicle enters or exits regularly, several RF cards need to be installed at the vehicle. Thus, esthetic appeal of the vehicle is lowered, and positions in which several RF cards are to be installed, are incommodious.

SUMMARY OF THE INVENTION

The present invention provides an apparatus for automatically controlling a crossing gate by sensing a light, in which the crossing gate is configured to be open according to a change in an amount of light of signal patterns of a light necessarily installed at a vehicle so that an economical burden for installing a radio frequency (RF) card at the vehicle can be reduced and in particularly, inconveniences caused by simultaneously installing several RF cards can be improved.

According to an aspect of the present invention, there is provided an apparatus for automatically controlling a crossing gate by sensing a light, the crossing gate being installed at an entrance/exit way of a vehicle and controlling entrance/exit of the vehicle, the apparatus including: a password setting unit for setting a combined row of input numbers or characters as a password; a signal sensing unit for sensing a change in an amount of light of light signal patterns of the vehicle; and a controller including a first signal converter that analyzes the sensed change in the amount of light of light signal patterns of the vehicle and that converts the analyzed light signal patterns into a Morse code, a second signal converter that converts the converted Morse code into a combined row of numbers or characters, and a driving controller that controls opening/closing of the crossing gate depending on whether the converted combined row of numbers or characters is the same as the password set by the password setting unit. The password setting unit may match the combined row of the input numbers or characters with a vehicle number or visitor's identification information, thereby setting the combined row as the password or updating the password.

According to another aspect of the present invention, there is provided an apparatus for automatically controlling a crossing gate by sensing a light, the crossing gate being installed at a vehicle, the apparatus including: a password inputting unit for inputting a combined row of numbers or characters as a password; a signal converter for converting the combined row of the input numbers or characters into a Morse code; and a signal generator for generating light signal patterns of the vehicle by driving a light of the vehicle according to the converted Morse code.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
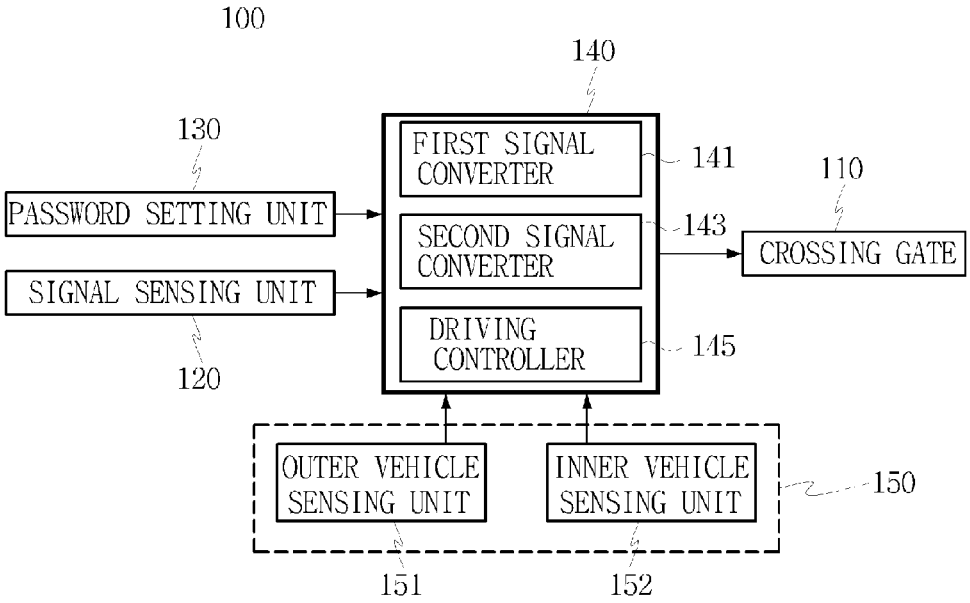
FIG. 1 illustrates a configuration of an apparatus for automatically controlling a crossing gate by sensing a light, according to an exemplary embodiment of the present invention, i.e., is a block configuration diagram of the apparatus for automatically controlling a crossing gate that is installed at an entrance/exit way of a vehicle and controls entrance and exit of the vehicle.

The present invention will now be described more fully with reference to the accompanying drawings, in which exemplary embodiments of the invention are shown.

When reference numerals are added to elements of the drawings, like reference elements are represented by the same reference numerals although they are shown in different drawings. Also, in the description of embodiments of the present invention, if it is determined that a detailed description of commonly-used technologies or structures related to the invention may unnecessarily obscure the subject matter of the invention, the detailed description will be omitted.

FIG. 1 illustrates a configuration of an apparatus 100 for automatically controlling a crossing gate by sensing a light, according to an exemplary embodiment of the present invention, i.e., is a block configuration diagram of the apparatus 100 for automatically controlling a crossing gate that is installed at an entrance/exit way of a vehicle and controls entrance and exit of the vehicle. As illustrated in FIG. 1, the apparatus 100 for automatically controlling a crossing gate by sensing a light may include a crossing gate 110, a signal sensing unit 120, a password setting unit 130, a controller 140, and a vehicle sensing unit 150.

The crossing gate 110 is installed at a vehicle entrance/exit way of a house, a parking lot, a building or a vehicle entrance/ exit way of a road tollgate, for example, a highway tollgate, and controls entrance and exit of the vehicle.

The signal sensing unit 120 is installed at the front and/or the rear of the crossing gate 110. When the vehicle is close to the crossing gate 110 and light signal patterns (or is referred to as light signal on/off patterns) are generated, the signal sensing unit 120 is configured to sense the light signal patterns and to transmit the light signal patterns to the controller 140. A change in an amount of light of the light signal patterns of the vehicle may be a change in an amount of light of signal patterns using a headlight of the vehicle or a change in an amount of light of signal patterns using a brake of the vehicle. That is, when a driver advances the vehicle and the vehicle enters the front of the crossing gate 110, a change in an amount of light of signal patterns of the headlight of the vehicle can be used, and when the driver reverses the vehicle and the vehicle enters the rear of the crossing gate 110, a change in an amount of light of signal patterns of the brake of the vehicle can be used.

The signal sensing unit 120 may include a light sensor or a closed-circuit television (CCTV). For example, the signal sensing unit 120 may check a change in an amount of light of signal patterns of the headlight or the brake of the vehicle using the light sensor or the closed-circuit television (CCTV).

The password setting unit 130 is used to set a combined row of numbers or characters input by a user, for example, 'jjLee003', as a password or to update the password. For example, the password setting unit 130 may match a combined row of numbers or characters input by the user with a vehicle number or visitor's identification information, thereby setting the combined row as the password or updating the password.

The controller 140 is used to analyze the change in the amount of light of signal patterns of the vehicle output from the signal sensing unit 120 and to output signals for controlling the crossing gate 110 to be open when the analyzed light signal patterns coincide with signal patterns corresponding to the password that is preset by the password setting unit 130. For example, the controller 140 may include a first signal converter 141, a second signal converter 143, and a driving controller 145.

The first signal converter 141 is used to analyze the change in the amount of light of signal patterns sensed by the signal sensing unit 120 and to convert the corresponding light signal patterns into a Morse code.

The second signal converter 143 is used to analyze the Morse code converted by the first signal converter 141 and to convert the analyzed Morse code into a combined row of corresponding numbers or characters.

The driving controller 145 is used to control opening/closing driving of the crossing gate 110 depending on whether the combined row of numbers or characters converted by the second signal converter 143 is the same as the password that is preset by the password setting unit 130.

The vehicle sensing unit 150 may include an outer vehicle sensing unit 151 that is installed at an outer bottom surface or side of an entrance/exit way of an apartment house, a public parking lot or a building, or a highway tollgate, and an inner vehicle sensing unit 152 that is installed at an inner bottom surface or side of the entrance/exit way of the apartment house, a public parking lot or a building, or a highway tollgate in a state in which the crossing gate 110 is a border between the outer vehicle sensing unit 151 and the inner vehicle sensing unit 152.

The vehicle sensing unit 150 including the outer vehicle sensing unit 151 and the inner vehicle sensing unit 152 senses whether the vehicle is close to the vicinity of the crossing gate 110, transmits a sensed signal to the controller 140 and enables the driver to know a side where the vehicle is placed in a state in which the crossing gate 110 is the border between the outer vehicle sensing unit 151 and the inner vehicle sensing unit 152. The vehicle sensing unit 150 may include a loop detector or a laser sensor, for example.

Figure 2:
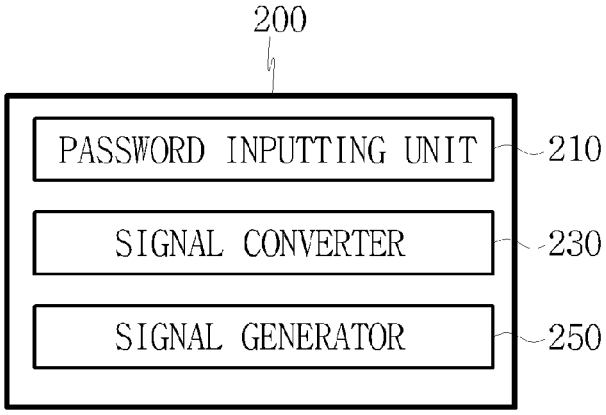
FIG. 2 illustrates a configuration of an apparatus for automatically controlling a crossing gate by sensing a light, according to another exemplary embodiment of the present invention, i.e., is a block configuration diagram of the apparatus for automatically controlling a crossing gate that is installed at a vehicle.

FIG. 2 illustrates a configuration of an apparatus 200 for automatically controlling a crossing gate by sensing a light, according to another exemplary embodiment of the present invention, i.e., is a block configuration diagram of the apparatus 200 for automatically controlling a crossing gate that is installed at a vehicle. As illustrated in FIG. 2, the apparatus 200 for automatically controlling a crossing gate by sensing a light may include a password inputting unit 210, a signal converter 230, and a signal generator 250.

The password inputting unit 210 is used to input a combined row of numbers or characters selected by a user as a password. For example, the password inputting unit 210 may include an analog keypad, a touch panel, or a voice input microphone that is installed at a front panel of a driver's seat of the vehicle.

The signal converter 230 is used to convert the combined row of numbers or characters input by the password inputting unit 210 into a Morse code.

The signal generator 250 is used to drive turn on/turn off of a light, such as a front headlight or a rear brake of the vehicle according to the Morse code converted by the signal converter 230 and to generate light signal patterns of the vehicle.

Subsequently, an operation of the present invention will be described with reference to FIGS. 3 through 7.

Figure 3:
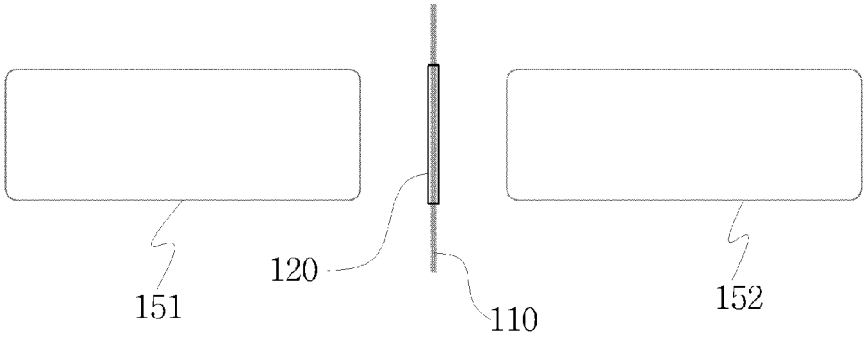
FIGS. 3 through 8 are schematic plan views illustrating various operation states according to the present invention.
Figure 4:
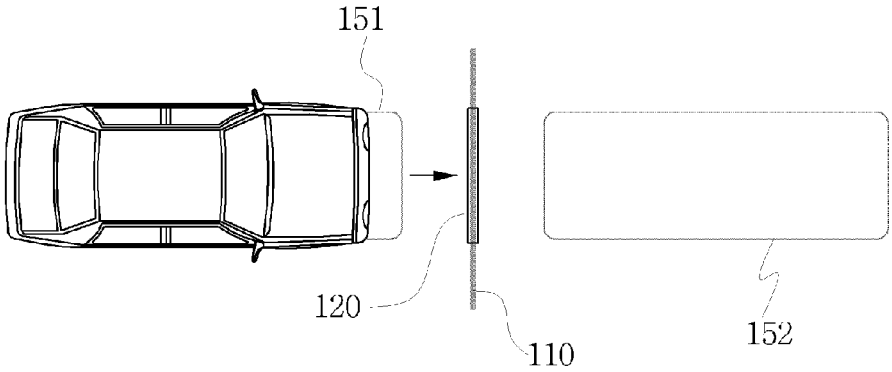
Figure 5:
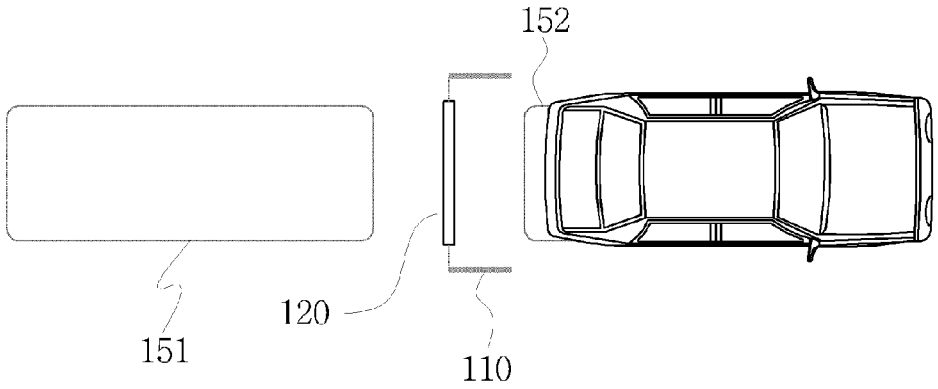
Figure 6:
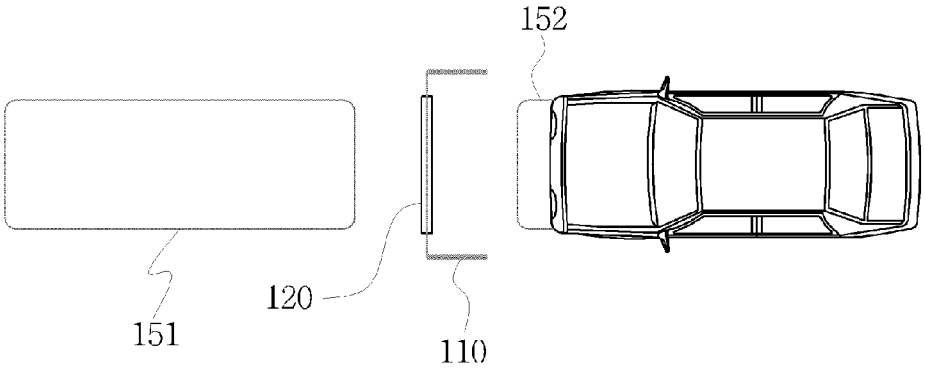
Figure 7:
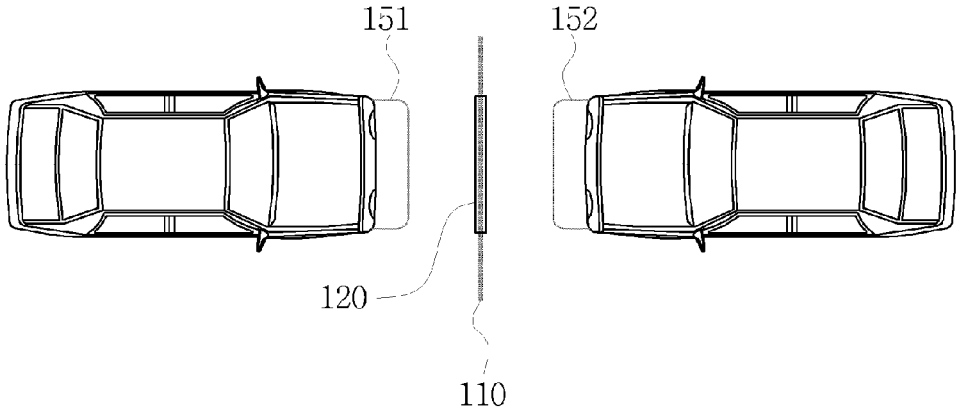

FIG. 3 is a schematic plan view illustrating a state in which the apparatus 100 for automatically controlling the crossing gate by sensing a light illustrated in FIG. 1 is installed, FIG. 4 illustrates a state in which an external vehicle enters an inside of the crossing gate in FIG. 3, FIG. 5 illustrates a state in which the vehicle passes through the crossing gate in FIG. 4, FIG. 6 illustrates a state in which an internal vehicle exits out of the crossing gate in FIG. 3, and FIG. 7 illustrates a state in which the vehicle enters both an outer side and an inner side of the crossing gate in FIG. 3.

In the apparatus 100 for automatically controlling the crossing gate by sensing a light illustrated in FIG. 1, first, as illustrated in FIG. 4, when a vehicle enters from the outside, the outer vehicle sensing unit 151 installed at an outer bottom surface of the entrance/exit way senses entrance of the vehicle and then transmits a sensed signal to the controller 140.

If light signal patterns (on/off) given by an administrator so that the driver can enter or exit are manually or automatically generated, a change in an amount of light of the generated light signal patterns is sensed by the signal sensing unit 120 installed at the front of the crossing gate 110 and then is transmitted to the controller 140. Thus, the controller 140 outputs a control signal for controlling an opening of the crossing gate 110 and causes entrance of the vehicle from the outside to the inside.

In this case, as illustrated in FIG. 5, if entrance of the vehicle to the inside is performed and the entering vehicle fully passes through the inner vehicle sensing unit 152 installed at an inner bottom surface in a state in which the crossing gate 110 is a border between the outer vehicle sensing unit 151 and the inner vehicle sensing unit 152, the passage state is sensed by the inner vehicle sensing unit 152 and then, a sensed signal is transmitted to the controller 140. The controller 140 recognizes the passage state of the vehicle and then controls the crossing gate 110 to be closed.

As illustrated in FIG. 6, when the internal vehicle exits out of the crossing gate in a state in which the crossing gate 110 is a border between the outer vehicle sensing unit 151 and the inner vehicle sensing unit 152, the inner vehicle sensing unit 152 installed at the inner bottom surface of the crossing gate 110 senses the vehicle and then transmits a sensed signal to the controller 140, and the controller 140 controls the crossing gate 110 to be open and causes the internal vehicle to exit out of the crossing gate.

Meanwhile, as illustrated in FIG. 7, when the internal vehicle is sensed by the inner vehicle sensing unit 150 installed at the inner bottom surface in a state in which the vehicle enters from the outside and the external vehicle is sensed by the outer vehicle sensing unit 151 installed at the outer bottom surface, the controller 140 controls the crossing gate 110 to be closed so that the external vehicle does not enter until the internal vehicle is out of the inner vehicle sensing unit 152. That is, although particular light signal patterns are sensed by the signal sensing unit 120 from the external vehicle and the sensed signal is proper until a sensed signal indicating that the vehicle is out of the inner bottom surface is transmitted from the inner vehicle sensing unit 150, the controller 140 controls the crossing gate 110 to be closed so that the external vehicle does not enter. Thus, a collision accident with a preceding vehicle can be prevented.

In the present invention, the apparatus 200 for automatically controlling the crossing gate by sensing a light illustrated in FIG. 2 may be or may not be mounted on the vehicle.

For example, when the apparatus 200 for automatically controlling the crossing gate by sensing a light of FIG. 2 is not mounted on the vehicle, a light of the vehicle may be driven to be manually turn on/off according to the light signal patterns given by the administrator so that the driver can enter or exit, and light signal (on/off) patterns may be generated, and the generated light signal patterns may be sensed by the signal sensing unit 120.

Alternatively, when the apparatus 200 for automatically controlling the crossing gate by sensing a light of FIG. 2 is mounted on the vehicle, if the driver has only to input a password given by the administrator through the password inputting unit 210 so that the driver can enter or exit, the password input by the signal converter 230 may be converted into a Morse code, and the signal generator 250 may drive the light of the vehicle to be automatically turn on/off according to the Morse code so as to generate light signal (on/off) patterns, and the generated light signal patterns may be sensed by the signal sensing unit 120 so that driver's conveniences can be improved.

Figure 8:
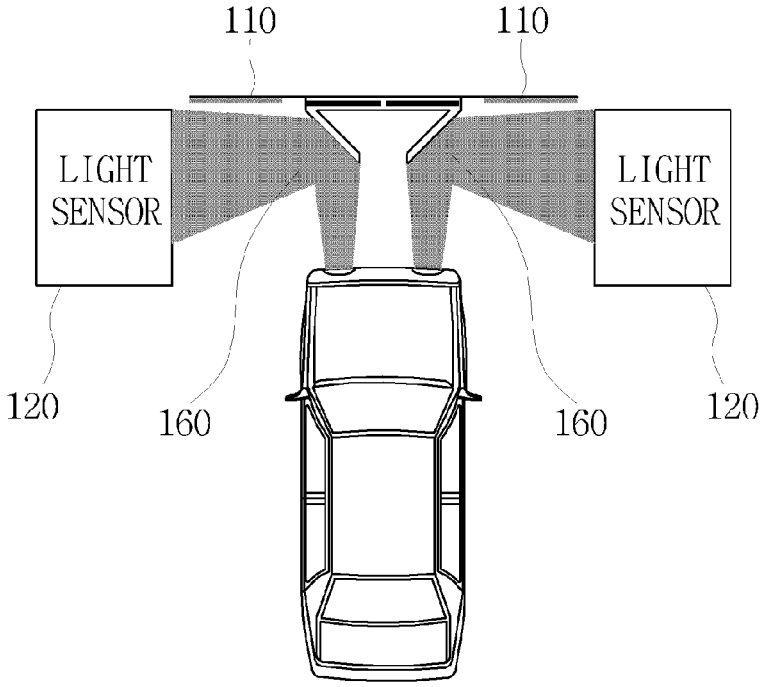

FIG. 8 illustrates another embodiment of the present invention. In FIG. 8, when there is no space in which a signal sensing unit 120 is to be installed, in the crossing gate 110 and signal sensing units 120 cannot help being installed at both sides of the crossing gate 110, a reflection mirror 160 that may reflect light signal patterns by the signal sensing unit 120 is installed at the front of the crossing gate 110.

For example, a plurality of small reflection mirrors 160 having a fish scalelike shape may be installed at the front of the crossing gate 110 and may reflect signal patterns not to affect opening/closing of the crossing gate 110 and not to be damaged by opening/closing of the crossing gate 110.

An operation of the embodiment of FIG. 8 will now be briefly described.

First, when vehicle entrance/exit is performed from the outside and the outer vehicle sensing unit 151 installed at the outer bottom surface of the entrance/exit way senses vehicle entrance/exit and then transmits a sensed signal to the controller 140. When the driver manually or automatically generates particular light signal (on/off) patterns given by the administrator so as to enter or exit, the generated particular light signal patterns are reflected by the light sensor of the signal sensing unit 120 through the reflection mirror 160 installed at the crossing gate 110, and the signal sensing unit 120 senses the signal patterns reflected through the reflection mirror 160 and then transmits a sensed signal to a driving controller 145 of the controller 140, and the driving controller 145 outputs a control signal for controlling opening of the crossing gate 110 so that vehicle entrance/exit can be performed from the outside to the inside.

As described above, according to the one or more embodiments of the present invention, a crossing gate is configured to be open according to a change in an amount of light of signal patterns of a light necessarily installed at a vehicle so that an economical burden for installing a radio frequency (RF) card at the vehicle can be reduced and in particularly, although there are a plurality of places, for example, a house, an office, and the like, in which the vehicle enters and exits regularly, a driver has only to know a password of a corresponding place or corresponding light signal patterns so that inconveniences caused by simultaneously installing several RF cards can be improved. In addition, when the driver is the same person and vehicles are continuously changed due to frequent entrance and exit of a working vehicle or a commercial motor vehicle, the driver does not need to install an RF card and has only to know a password or corresponding light signal patterns so that there is no problem in entrance and exit of the vehicle.

While this invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An apparatus for automatically controlling a crossing gate by sensing a light, the crossing gate being installed at an entrance or exit way of a vehicle and controlling entrance or exit of the vehicle, the apparatus comprising:

a password setting unit for setting a combined row of input numbers or characters as a password;

a signal sensing unit for sensing a change in an amount of light of light signal patterns of the vehicle; and a controller comprising a first signal converter that analyzes the sensed change in the amount of light of light signal patterns of the vehicle and that converts the analyzed light signal patterns into a Morse code, a second signal converter that converts the converted Morse code into a combined row of numbers or characters, and a driving controller that controls opening or closing of the crossing gate depending on whether the converted combined row of numbers or characters is the same as the password set by the password setting unit.

2. The apparatus of claim 1, wherein the password setting unit matches the combined row of the input numbers or characters with a vehicle number or visitor's identification information, thereby setting the combined row as the password or updating the password.

3. An apparatus for automatically controlling a crossing gate by sensing a light, the crossing gate being installed at an entrance or exit way of a vehicle, the apparatus comprising:

a password inputting unit for inputting a combined row of numbers or characters as a password;

a signal converter for converting the combined row of the input numbers or characters into a Morse code; and a signal generator for generating light signal patterns of the vehicle by driving a light of the vehicle according to the converted Morse code.

* * * * *